United States Patent [19]

Puncochar

[11] Patent Number: 4,825,729

[45] **Date of Patent: * May 2, 1989**

[54] TORQUE TRANSFER GEAR SYSTEM

[76] Inventor: Norbert L. Puncochar, 460 Phirne Crt., East, Glen Burnie, Md. 21061

[ * ] Notice: The portion of the term of this patent subsequent to Mar. 17, 2004 has been disclaimed.

[21] Appl. No.: 21,006

[22] Filed: Mar. 2, 1987

Related U.S. Application Data

[63] Continuation-in-part of Ser. No. 770,057, Aug. 27, 1985, Pat. No. 4,649,776.

[51] Int. Cl.[4] ..... B25B 17/00

[52] U.S. Cl. ..... 81/57.3; 74/431; 74/433

[58] Field of Search ..... 81/57, 57.14, 57.3; 74/413, 433, 665 B, 665 E, 665 G, 457, 460, 462, 445, 431, 432, 437, 459.5

[56] References Cited

U.S. PATENT DOCUMENTS

| | | | |
|---|---|---|---|
| 54,589 | 5/1866 | Palmer et al. | 173/19 |
| 282,322 | 7/1883 | Hopkins | 74/460 |
| 294,819 | 3/1884 | Speers, Sr. | 74/457 |
| 1,423,142 | 7/1922 | Owens | 81/57.3 |
| 2,817,256 | 12/1957 | Malone et al. | 81/57 |
| 2,830,479 | 4/1958 | Finn | 81/57 |
| 2,863,347 | 12/1958 | Nelson | 81/52.4 |
| 3,535,960 | 10/1970 | Bonnies | 81/57.14 |
| 3,699,822 | 10/1972 | Wildhaber | 74/437 |
| 3,987,691 | 10/1976 | Sauafe | 81/57.3 |
| 4,063,475 | 12/1977 | Perkins | 81/57.22 |
| 4,308,760 | 1/1982 | Voigtlander et al. | 74/459.5 |
| 4,374,479 | 2/1983 | Minotti | 81/57.3 |
| 4,374,480 | 2/1983 | Diaz | 81/57.3 |

FOREIGN PATENT DOCUMENTS 2056348 3/1981 United Kingdom .

*Primary Examiner*—Frederick R. Schmidt
*Assistant Examiner*—Maurina Rachuba
*Attorney, Agent, or Firm*—Shlesinger & Myers

[57] ABSTRACT

A torque transfer gear system comprises a plurality of first and second torque disks. The first torque disks each comprise a disk having first and second parallel surfaces and a plurality of gear teeth extending equiangularly thereabout but not extending radially beyond the associated disk circumference. The second torque disks likewise include a disk having a plurality of equiangularly disposed teeth, and the teeth do not extend beyond the associated disk circumference. The first torque disks are disposed in spaced apart relation and are rotatable on parallel axes. The second torque disks are also disposed in spaced apart relation and the teeth of the second torque disks are in meshing engagement with the teeth of the adjacent first torque disks. Application of torque to one of the first torque disks causes all torque disks to rotate and thereby transfer torque from one disk to another.

12 Claims, 2 Drawing Sheets

FIG 1
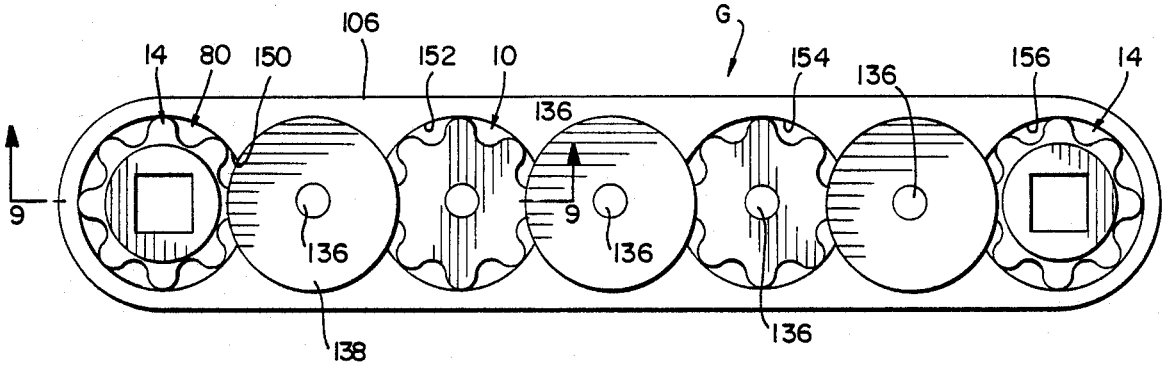
FIG 2
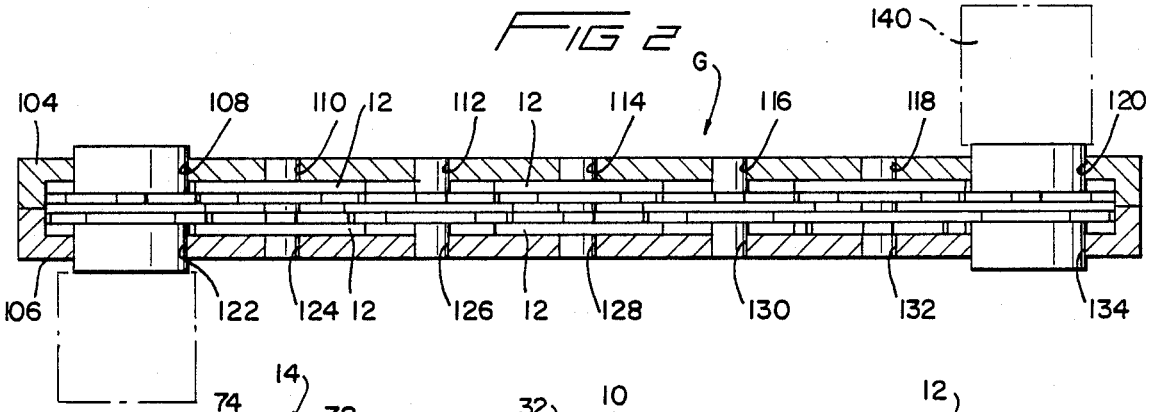
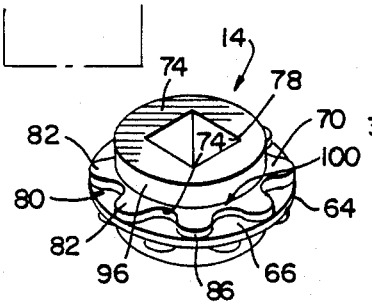
FIG 3
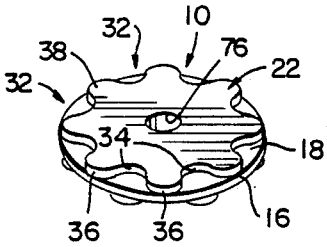
FIG 5
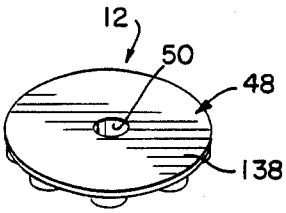
FIG 7
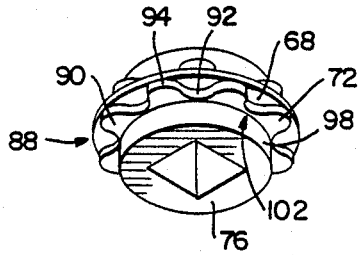
FIG 4
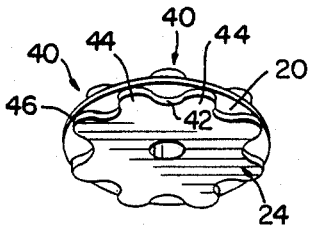
FIG 6
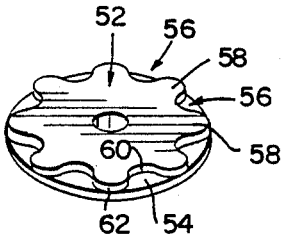
FIG 8

TORQUE TRANSFER GEAR SYSTEM

RELATED APPLICATIONS

This application is a continuation-in-part of my copending patent application, Ser. No. 770,057, filed Aug. 27, 1985, U.S. Pat. No. 4,649,776, patented Mar. 17, 1987 entitled Extension for Socket Tool Drive System, the disclosure of which is incorporated herein by reference.

BACKGROUND OF THE INVENTION

Torque is the term applied to a uniform or fluctuating turning moment exerted by a tangential force acting at a distance from the axis of rotation, and may be expressed in any one of a number of formats, such as ft.lb. Transfer of torque between two relatively moving and engaged bodies is not easily accomplished with conventional gear systems. More specifically, transfer of torque with conventional gears frequently causes the teeth thereof to become bent, thereby causing the gears to become locked together.

Transfer of torque by relatively rotating bodies causes the contact pressures to be relatively high when the gear teeth are interengaged or meshed. The gear teeth are usually relatively thin at the terminus, and normally taper gradually away from the gear body proper. Naturally, the thinner the gear tooth, then the less resistance to bending moments and the like. One way of increasing the ability of the teeth to withstand high bending moments is to increase the thickness of the gear, that is its axial dimension, in order to spread out the bending force. Unfortunately, the thicker the gear is, then the greater the space required. Furthermore, there is a practical limitation concerning weight which must be considered, particularly when a number of gears are used in a system.

Conventional torque wrenches cause the applied torque to be directly applied to the part which is to operated on, such as a nut or bolt. Because of the previously described limitations with regard to gear transfer systems, there has not been a successful extension capable of transferring torque to the place required. It is frequently very difficult for the conventional torque wrench to be directly connected to a particular part, such as a frozen nut, and an extension is therefore desirable, particularly in closely confined areas.

In view of the above, the disclosed invention provides a novel gear system permitting torque to be transferred between relatively rotating disk-like bodies. Unlike a conventional gear system, the gear teeth do not extend beyond the circumference or periphery of the disk body, and therefore the teeth have greater strength and can withstand higher bending moments. An embodiment is also disclosed utilizing paired torque disks in order to permit the applied moments to be effectively reduced.

OBJECTS AND SUMMARY OF THE INVENTION

The primary object of the disclosed invention is a gear system permitting torque to be transferred between at least three relatively rotating disk-like bodies.

A further object of the disclosed invention is to provide a gear system, for transferring torque, which may be assembled in the manner of an extension and which is relatively thin and lightweight.

A torque transmitting gear system comprises drive gear means rotatable on a first axis and including a first disk having first and second generally parallel surfaces and a first set of roots extending through the first surface and terminating short of the second surface and providing a first set of gear teeth. Each tooth has a semicircular periphery directed away from the axis and terminating at the periphery and each root has a corresponding semicircular periphery directed toward the axis. At least a first idler gear means is rotatable on a second axis parallel to the first and includes a second disk having third and fourth generally parallel surfaces. The third surface is aligned with and parallel to the second surface. A second set of roots extend through the fourth surface and terminate short of the third surface and provide a second set of gear teeth. The second set of teeth are correspondingly configured with relation to the first set. The teeth of the first and second sets are meshingly engaged so that rotation of the drive gear means causes the teeth thereof to be successfully positioned within the roots of the first gear means for therewith causing the first idler gear means to rotate. A driven gear means rotatable on a third axis includes a third disk having fifth and sixth surfaces. The fifth surface is aligned with and parallel to the fourth surface. A third set of roots extend through the sixth surface and provide a third set of gear teeth. The teeth of the third set are shaped to correspond with the teeth of the first and second sets. The teeth of the second and third sets are meshingly engaged so that rotation of the first idler gear means causes the teeth thereof to be successfully positioned within the roots of the driven gear means for therewith causing the driven gear means to rotate. Means are provided for applying a torque to the drive gear means and means are provided for maintaining the axes parallel and the teeth thereby meshingly engaged.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein:

FIG. 1 is a top plan view of a gear system for transferring torque between relatively rotating bodies;

FIG. 2 is a cross-sectional view of FIG. 1 disclosing the means for applying torque and the means for having the torque applied in phantom;

FIG. 3 is a top perspective view of a first one of my torque disks;

FIG. 4 is a bottom perspective view thereof;

FIG. 5 is a top perspective view of a second type of torque disk;

FIG. 6 is a bottom perspective view thereof;

FIG. 7 is a top perspective view of a third type of torque disk;

FIG. 8 is a bottom perspective view thereof;

DESCRIPTION OF THE INVENTION

Figure 9:
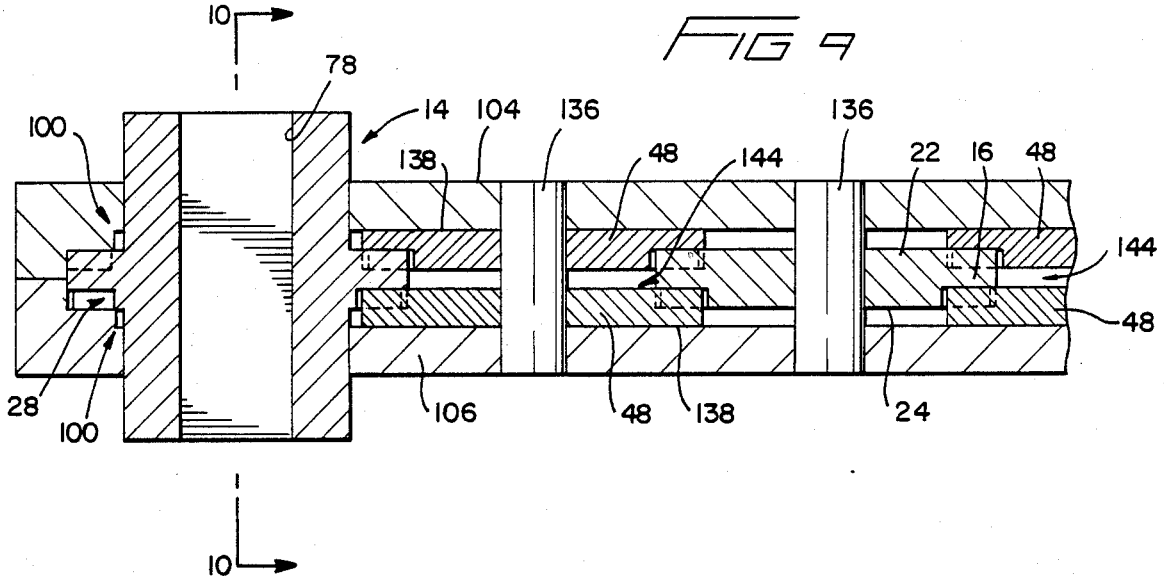
FIG. 9 is a fragmentary cross-sectional view taken along the section 9—9 of FIG. 1 and viewed in the direction of the arrows; and, FIG. 10 is a cross-sectional view taken along the section 10—10 of FIG. 9 and viewed in the direction of the arrows.

Gear system G, as best shown in FIGS. 1 and 2, is comprised of a plurality of meshingly engaged first and second torque disks 10 and 12, respectively, as best shown in FIGS. 5 and 7, and third torque disks 14. The torque disk 14 of FIG. 3 corresponds substantially to the torque disk 10 of FIG. 5, except as will be further noted below. Preferably, each of the torque disks 10, 12 and 14 is comprised of a metal or a metal alloy and has at least a 56 Rockwell hardness, but no more than a 63 Rockwell hardness. Preferably, each of the disks has a 58 Rockwell hardness.

Disk 10, as best shown in FIGS. 5 and 6, has a central disk member 16. Disk member 16 has upper and lower generally planar parallal surfaces 18 and 20. Toothed members 22 and 24 are integral with the surfaces 18 and 20, respectively, and may be formed by conventional metal working techniques, such as forging, machining powder metal forming and the like. Also to be noted in FIGS. 5 and 6 is the central aperature 26 extending through the planar surfaces 28 and 30 of the members 22 and 24, respectively.

A plurality of valley-like roots 32 are equiangularly disposed about the member 22 and provide equiangularly positioned and circumferentially disposed teeth. The roots 32 each have a semicircular portion 34 directed toward the axis defined by the aperture 26. Each of the teeth has a semicircular portion 36 which terminates at the periphery of the disk member 16. The semicircular portions 36 correspond in size with the semicircular portions 34, for reasons to be explained. Perferably, there are eight teeth disposed about the member 22. Naturally, two roots 32 serve to define a single tooth, such as the tooth 38 of FIG. 5.

FIG. 6 discloses the roots 40 formed in the disk member 24. The roots 40 each have a valley-like semicircular portion 42 which is directed toward the axis defined by the aperture 26. Similarly, each of the teeth 44 has a semicircular portion 46 which terminates at the periphery of disk 18. Naturally, the semicircular portions 46 have a size corresponding with the size of the semicircular portions 42.

It should be noted in FIG. 6 that there are a similar number of teeth 46 with regard to the disk member 24 as there are with the teeth 38 of the disk member 32. FIGS. 5 and 6 also disclose that the teeth 38 are circumferentially offset, preferably by 22½°, from the teeth 44 of the disk member 24. The offset relationship of the teeth 38 and 44 assures that one tooth of a disk is always in meshing engagement with a root of the adjacently disposed disk, thereby permitting smooth rotation of the disks.

Torque disk 12 includes a disk 48 having a centrally disposed aperture 50, as best shown in FIG. 7. Toothed member 52 is integral with disk 48 and extends axially from planar surface 54, as best shown in FIG. 8. A plurality of roots 56 are formed in toothed member 52 and provide teeth 58 which are equiangularly disposed thereabout. Each of the roots 56 has a valley-like semicircular portion 60 which is directed towards the axis defined by the aperture 50. A correspondingly configured crest-like semicircular portion 62 is provided for each of the teeth 58. The semicircular portions 62 terminate at the periphery of disk 48.

Preferably, the teeth 58 each have a size and configuration conforming to that provided by the roots 32 and 40 of the torque disk 10. Preferably, the teeth 58 of the torque disk 12 correspond in number with the teeth 38 and 40 of the torque disk 10, although a different number may be used in the manner of a transmission. The semicircular portions 62 of the toothed member 52 assure good meshing engagement within the roots 40 and 32 of the torque disk 10.

Figure 10:
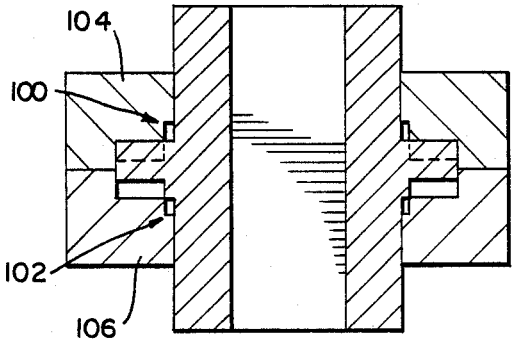

As noted previously, the torque disk 14 corresponds substantially to the disk 10. In this regard, torque disk 14 includes a disk 64 having substantially parallel surfaces 66 and 68, as best shown in FIGS. 3 and 4. Toothed members 70 and 72 extend axially from the surfaces 66 and 68, respectively. Extensions 74 and 76 extend axially from the members 70 and 72, as best shown in FIGS. 3 and 4, and have a diameter somewhat less than the diameter of the disk 64. A square-configured opening 78 extends through the extensions 74 and 76, as best shown in FIGS. 9 and 10, in order to permit connection with a torque applying or applied to means, such as a socket wrench or a socket.

A plurality of roots 80 are equiangularly disposed about and formed in the member 70 and provide a plurality of teeth 82. Each of the roots 80 has a valley-like semicircular portion 84 directed towards the axis defined by the opening 78. Each of the teeth 82 has a crest-like semicircular portion 86 which terminates at the periphery of the disk 64. The portions 84 and 86 have corresponding size and also correspond in size and configuration with the corresponding portions 34 and 36, and 42 and 46 of the torque disk 10. The number of teeth 82 disposed about the member 70 preferably corresponds with the number of teeth formed about the torque disk 10 and 12.

Likewise, a plurality of roots 88 are equiangularly disposed about and formed within the toothed member 72. The roots 88 form teeth 90 which are circumferentially offset from the teeth 82 of the disk 70, preferably by approximately 22½°. Each of the roots 88 has a valley-like semicircular portion 92 which is directed towards the axis defined by the opening 78. Similarly, each of the teeth 90 has a crest-like semicircular portion 94 which terminates at the periphery of the disk 64.

FIGS. 3 and 4 disclose that the extensions 74 and 76 are cylindrical and have a periphery 96 and 98, respectively, which is radially inwardly disposed relative to the semicircular portions 84 and 92. As a result, lubrication bearing platforms 100 and 102, respectively, are disposed about the axially spaced surfaces of the toothed members 70 and 72.

FIG. 2 discloses housing members 104 and 106 which are mated together by conventional means. Each of the housing members has a plurality of recessed portions within which the appropriate torque disks are seated for rotation on the respective axes. Furthermore, housing member 104 includes apertures 108, 110, 112, 114, 116, 118 and 120 which are coaxial with the associated recesses. It is to be noted that the apertures 108 and 120 have a diameter substantially in excess of that provided by the other apertures. Corresponding apertures 122, 124, 126, 128, 130, 132 and 134 are provided within the housing 106 and are coaxial with the apertures within the housing 104. Recesses 150, 152, 154 and 156 are shown in FIG. 1. Those skilled in the art will appreciate that there is a recess for each such disk. The coaxial apertures 108, 122 and 120, 134 have a diameter corresponding substantially to the diameter of the extensions 74 and 76. A torque disk 14, which acts as a driver gear, has the extension 76 thereof rotatable positioned within the aperture 122, while a disk 14, acting as a driven gear, has the extension 76 thereof position with aperture 134. Shafts 136 are fixedly positioned within the remaining coaxial apertures to define a plurality of rotational axes. Shafts 136 extend in linear alignment with the axes defined by the apertures 108, 122 and 120, 134, although arcuate configurations are possible.

A torque disk 12 is positioned about the shaft 136 of aperture 124 so that the surface 138 thereof rests upon the associated recess in housing 106. The teeth 58 are meshingly engaged with the roots 88 of the driven disk 14. A second disk 12 is positioned about the shaft 136 of the aperture 110 so that the surface 138 thereof rests upon the associated recess in housing 104 when the housing members 104 and 106 are mated. As a consequence thereof, the teeth 58 are meshingly engaged with the roots 80 of the adjacent driven disk 14. In this way, rotation of the coaxial disks 12 will cause corresponding rotation of the driven disk 14 positioned within the apertures 108 and 122.

A torque disk 10 is positioned about the shaft 136 of the apertures 112 and 126. The disk 10 has the roots 32 thereof aligned with the teeth 58 of the adjacently disposed upper disk 12. Similarly, the roots 40 are in meshing engagement with the roots of the adjacently disposed lower disk 12. In this way, the meshing engagement of the disk 10 with the adjacently disposed disks 12 permits rotation of one and another. The alternating meshing sequence of idler disks 10 and 12 is repeated for the remaining aligned coaxial apertures until meshing engagement with the driver disk 14 is established. In this way, application of a torque to the driver disk 14, such as through a socket wrench, will cause rotation of all idler disks 10 and 12 and transfer of torque one to another and ultimately to driven disk 14.

FIG. 2 discloses torque application means 140 in operative connection with the driver disk 14. Also illustrated is the torque transfer device 142 which is in operative connection with the driven disk 14. Those skilled in the art will understand that application of torque through the means 140 will cause that torque to be rotationally transferred between the meshingly engaged disks 10, 12 and 14 until ultimately applied to the means 142. The means 140 can include a conventional socket wrench, which is particularly adapted for having an operative portion thereof positioned within the aperture 78, although other torque application means will be recognized by those skilled in the art. Similarly, the torque transfer means 142 can include a well known socket for transferring the torque to a nut or bolt, or the like, although other means are similarly of interest.

FIG. 9 discloses the axially disposed gap 144 between the coaxially associated torque disks 12. The relative dimension of this gap 144 can be adjusted as needed, or as dictated by the particular circumstances. Naturally, the axial dimension of the gap 144 will be related to the distance between the surfaces 66 and 68 and 18 and 20 of the torque disks 14 and 10, respectively. While it is conceivable that the aligned disks 12 can be in touching contact, I prefer that the gap 144 be provided in order to decrease friction and the weight of the gear system G. FIG. 9 also discloses the parallel alignment of respective surfaces of the disks. Parallel alignment prevents the disks from canting and thereby becoming bound.

FIG. 9 furthermore discloses the offset relationship between the gear teeth 82 and 90 of the torque disks 14, as well as between the teeth 38 and 44 of the disks 10, and the teeth 58 of the coaxial disks 12. I have found that offsetting the teeth permits the torque to be transferred in a smoother manner than occurs when the teeth are uniformly coaxially aligned. I believe that the smooth transfer is due to the fact that one tooth of each disk is always in meshed engagement with the root of an adjacently disposed disk throughout the entire rotational period. This offset relationship effectively reduces the load on a tooth by 50%. Reduction of the loading permits the torque disks to be that much thinner, thereby providing a much more compact and lightweight device.

It is important that the gear teeth of the torque disks 10, 12 and 14 not extend beyond the periphery of the associated disk. I have found that maintaining the teeth in alignment with the disk periphery provides a stronger tooth, a thinner tooth and one which is capable of withstanding relatively high bending moments. I believe that the strengthened teeth may be due, in part, to the reenforcement which is provided by the adjacent and integral disk body itself. In other words, the periphery of a tooth is supported by the disk, in contrast to the prior art gear teeth wherein there is no such lateral support. Furthermore, the semicircular peripheries of the teeth and roots permits smooth interdigitation avoiding temporary high stress concentrations.

The grease platforms 100 and 102 are best shown in FIGS. 9 and 10. These grease platforms permit a lubricant to be retained upon the disks 14 in order to minimize any friction which could occur.

I have found that the disks 10, 12 and 14 should each have eight teeth for best operation. Should there be less than six teeth, then the diameter of the disks decreases by too much of an amount. Furthermore, ten teeth requires a relatively large diameter. It is important that the gear system G be kept as compact as possible in order to permit remotely located parts to be operated upon.

Similarly, a 58 Rockwell hardness is preferred. Should the hardness be less than 56, then the disks may be too soft and not able to withstand the bending moments without distortion. Should the hardness be above 63, then the disks may be too brittle and likewise not able to withstand the high loading which may be applied through a pneumatically wrench or the like.

While this invention has been described has having a preferred design, it is understood that it is capable of further modifications, uses and/or adaptations of the invention following in general the principle of the invention and including such departures from the present disclosure as come within known or customary practice in the art to which the invention pertains, and as ay be applied to the central features hereinbefore set forth, and fall within the scope of the invention of the limits of the appended claims.

What I claim is:

1. A torque transfer gear system, comprising:

(a) a plurality of first torque disk means, each first torque disk means comprising a disk having first and second generally parallel surfaces and a plurality of first teeth means equiangularly disposed about each surface and said first teeth means not extending radially beyond the associated disk circumference;

(b) a plurality of second torque disk means, each of said second torque disk means comprising a disk and a plurality of second teeth means equianguarly disposed thereabout and said second teeth means not extending radially beyond the associated disk circumference;

(c) said first disk means disposed in spaced apart relation and said first disk means being rotatable on parallel axes;

(d) said second disk means disposed in spaced apart relation for rotation on parallel axes parallel to said first disk means axes and the teeth means thereof are in meshing engagement with the teeth means of the immediately adjacent first disk means and each second disk means in coaxial relation with another second disk means so that the teeth means of each surface of said first disk means are in meshing engagement with a teeth means of a second disk means; and, (e) means for applying a torque to one of said disk means for causing rotation of all disk means and transfer of the applied torque therebetween.

2. The system of claim 1, wherein:

(a) the disks of said first disk means rotating on a common plane; and, (b) said coaxial second disk means being spaced apart.

3. The system of claim 1, wherein:

(a) each teeth means comprising a plurality of teeth, each tooth being defined by a root opening away from the associated axis; and, (b) there being a uniform number of teeth for all disk means.

4. The system of claim 3, wherein:

(a) the disks of said first and second disk means having a uniform diameter and being uniformly spaced apart.

5. The system of claim 1, wherein:

(a) the teeth means of each first surface being angularly offset from the associated teeth means of each second surface; and, (b) the teeth means of each second disk means being angularly offset from the teeth means of the associated coaxial second disk means.

6. The system of claim 1, wherein:

(a) each second disk means being disposed between two of said first disk means.

7. The system of claim 5, wherein:

(a) the teeth means of each second disk means being disposed axially adjacent and extending toward the teeth means of the associated coaxial second disk means.

8. The system of claim 1, wherein:

(a) said torque applying means being associated with an end one of said first disk means.

9. The system of claim 8, wherein:

(a) the axes of rotation of said first and second disk means being linearly aligned.

10. The system of claim 3, wherein:

(a) each root having a semicircular valley portion and each tooth having a semicircular crest portion, said valley and crest portions having corresponding size for permitting mutual interdigitation during rotation of the disk means.

11. The system of claim 10, wherein:

(a) each teeth means having at least six teeth and no more than ten teeth; and, (b) each disk means being comprised of metal and having at least a 56 Rockwell hardness and no more than a 63 Rockwell hardness.

12. The system of claim 5, wherein:

(a) the angular offset between said teeth means being $22\frac{1}{2}°$.

* * * * *